United States Patent [19]

Pandzik

[11] 4,373,870

[45] Feb. 15, 1983

[54] VARIABLE CAPACITY POSITIVE DISPLACEMENT TYPE COMPRESSOR

[75] Inventor: Richard T. Pandzik, Dayton, Ohio

[73] Assignee: General Motors Corporation, Detroit, Mich.

[21] Appl. No.: 169,598

[22] Filed: Jul. 17, 1980

[51] Int. Cl.[3] ..... F04B 1/18; F04B 39/10; F04B 49/02

[52] U.S. Cl. ..... 417/269; 417/440

[58] Field of Search ..... 417/440, 209, 270, 299, 417/274, 275, 306

[56] References Cited

U.S. PATENT DOCUMENTS

| | | | |
|---|---|---|---|
| 1,636,439 | 7/1927 | Riesner | 417/440 |
| 1,764,646 | 6/1930 | Riesner | 417/440 |
| 1,766,682 | 6/1930 | Pescara | 417/507 |
| 2,462,039 | 2/1949 | Gibson | 230/26 |
| 2,982,218 | 5/1961 | Lucien | 103/42 |
| 3,151,569 | 10/1964 | Muller | 103/173 |
| 2,261,541 | 7/1966 | Kocker | 230/31 |
| 3,295,748 | 1/1967 | Leitgob | 417/441 |
| 3,303,988 | 2/1967 | Weatherhead | 230/31 |
| 3,385,508 | 5/1968 | Shaw | 230/22 |
| 3,692,052 | 9/1972 | Cattanach | 417/299 |
| 3,759,057 | 9/1973 | English et al. | 62/196 |
| 3,967,644 | 7/1976 | St. Laurent | 137/512.1 |
| 4,026,122 | 5/1977 | Kuhn | 417/299 |

FOREIGN PATENT DOCUMENTS

| | | | |
|---|---|---|---|
| 2311198 | 12/1976 | France | 417/275 |

*Primary Examiner*—William L. Freeh
*Attorney, Agent, or Firm*—R. L. Phillips

[57] ABSTRACT

A reciprocating piston swash plate refrigerant compressor is disclosed having a variable pumping capacity control arrangement wherein the pumping capacity is varied by effecting communication between the compressor's suction side and one or more of the cylinders during compression. Such communication is provided by a bypass valve controlling an additional suction port formed in the head end of the cylinder in parallel with the normal valve controlled suction port therefor. The bypass valve is urged to open the bypass port by cylinder pressure acting directly and continuously on a small pressure responsive area thereof and is urged to close the bypass port by discharge pressure delivered to act on a large pressure responsive area thereof under the control of a separate control valve which alternatively communicates suction side pressure with the large pressure responsive area when it is desired to permit the bypass valve to be opened by the cylinder pressure.

3 Claims, 3 Drawing Figures

VARIABLE CAPACITY POSITIVE DISPLACEMENT TYPE COMPRESSOR

This invention relates to variable capacity positive displacement type compressors and more particularly to those wherein the pumping capacity is varied by effecting communication between the compressor's suction side and one or more of the cylinders during compression.

There are various known ways in which the pumping capacity of positive displacement compressors such as the reciprocating piston type can be varied other than by varying the piston stroke or on/off cycling. For example, it is known that the pumping capacity can be varied by unloading one or more of the cylinders by allowing the fluid to reach the suction side through either the suction valve, discharge valve or a cylinder side port. However, these methods have the drawback of requiring additional clearance volume and/or restrict free passage of the fluid back to suction and as a result, reduce the efficiency. Furthermore, such methods typically require an unloading mechanism which is activated either by supplying oil pressure or by controlling a flow of the working fluid. The oil pressure activated method thus requires an oil pump while on the other hand, the working fluid flow method typically allows some high pressure fluid to return to suction either continuously or intermittently which wastes energy. Furthermore, it appears to be a characteristic of some prior unloading control devices that they exhibit some degree of instability. For example, the unloading of a cylinder(s) can cause a feedback signal in a working fluid activated unloading mechanism that will reactivate the cylinder(s) and result in continuous hunting of the system. Other observed drawbacks in prior systems include complexity of design and overpressure in the cylinder(s) when not unloaded. With regard to the latter, the prevention of any such overpressuring is especially beneficial during start-up when the high suction pressure causes a large volume of fluid to enter the cylinder which, during compression, can quickly reach a value substantially higher than the discharge pressure.

The present invention is directed to overcoming all such objectionable features and deficiencies with an improved variable capacity control arrangement of simple design which utilizes a suction bypass valve on each cylinder to have its pumping capacity reduced (unloaded) that is activated by static working fluid and automatically operates in a positive manner to limit overpressure in the cylinder when not unloaded. The present invention is disclosed in its preferred form incorporated in a swash plate type reciprocating piston compressor especially adapted for vehicle air conditioning use, such compressor having aligned pairs of cylinders with reciprocating double-ended pistons and suction and discharge valves associated therewith at each working end. The improved variable capacity control arrangement comprises a unique combination in association therewith. In the combination, there is provided a bypass passage for each cylinder which is to be unloaded that is located in the head end thereof and is connected in parallel with the suction valve for this cylinder between the fluid supply therefor (suction side) and the working end of the cylinder. A bypass valve operable to open and close the bypass passage is provided having a first pressure responsive area which is acted on by fluid pressure direct from the cylinder through the bypass passage whereby the bypass valve is urged thereby to open the bypass passage. The bypass valve is further provided with a second pressure responsive area which is substantially larger than and faces in a direction opposed to the first pressure responsive area. A control valve is then provided for alternately communicating the second or large pressure responsive area of the bypass valve with either the suction pressure or the discharge pressure from the cylinder through its discharge valve. In the former case, the fluid force exerted on the bypass valve during the compression stroke by the cylinder pressure acting on the small pressure responsive area substantially exceeds the fluid pressure which is exerted by the suction pressure acting on the large pressure responsive area. The bypass valve is moved by such force imbalance and is thereafter maintained thereby to open the bypass passage and thus effectively reduce the pumping capacity of the cylinder. Alternatively, when the discharge pressure is directed to act on the large pressure responsive area of the bypass valve, the resulting force will remain greater than the force exerted by the pressure in the cylinder acting on the small pressure responsive area, except during start-up, so that the bypass valve is moved by such force imbalance and thereafter maintained to close the bypass passage to establish and maintain the normal pumping activity of the cylinder. During start-up, the bypass valve will momentarily open or remain open because of the transient fluid pressure force imbalance in the bypass valve opening direction caused by delay in discharge pressure buildup at the bypass valve with the result that excess pressure is then allowed to escape back to the suction side via the bypass passage and thus reduce the start-up torque. Furthermore, the above combination can be combined with any number of the compressor's cylinders (one to all) according to the degree of pumping capacity control desired, such determination being based on simple proportionality.

These and other objects, advantages and features of the present invention will become more apparent from the following description and drawing in which.

Figure 1:
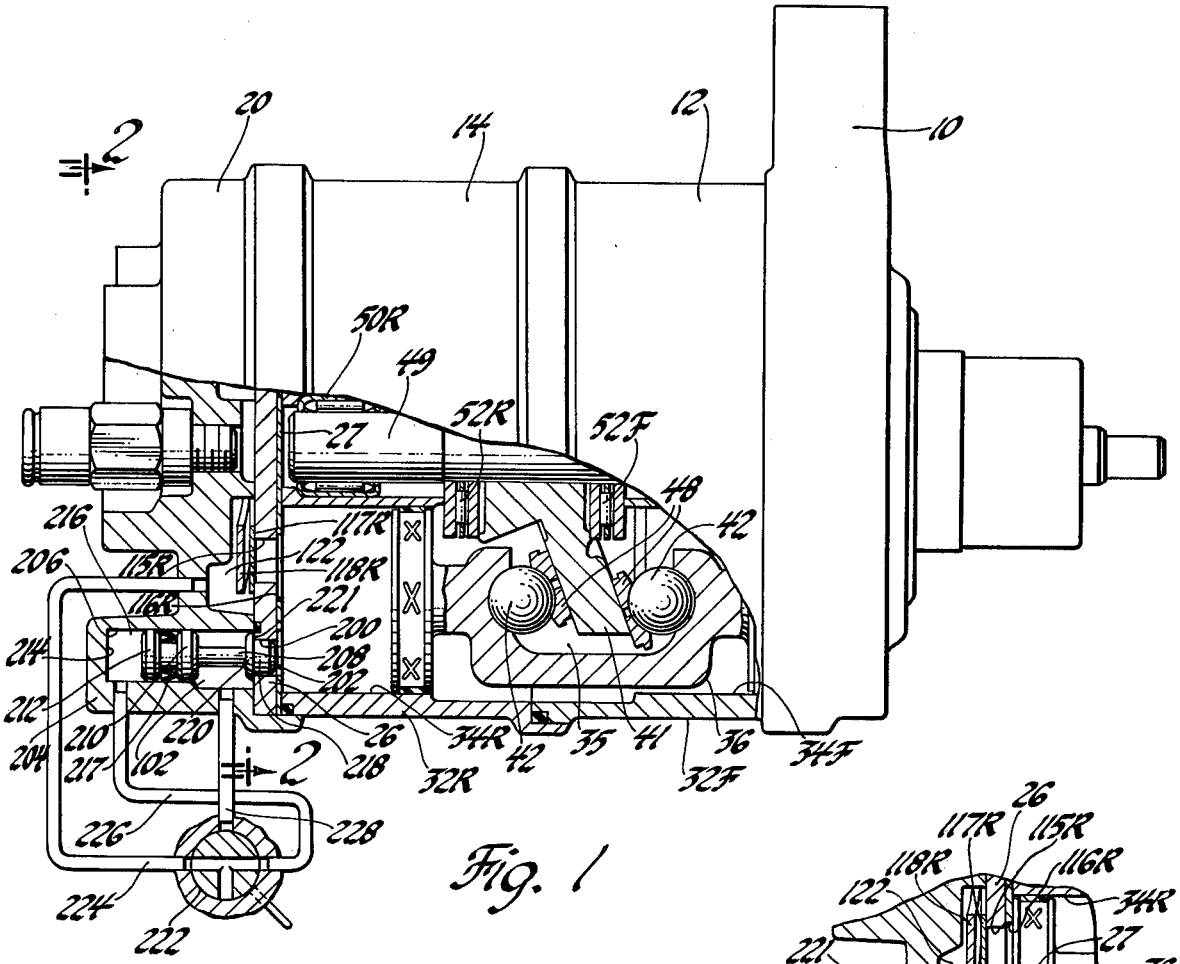
FIG. 1 is a side view with parts broken away and parts shown diagrammatically of a swash plate reciprocating piston type refrigerant compressor for vehicle use embodying the present invention, the valve arrangement thereof being shown in its load or full pumping capacity condition.

Referring to the drawings, there is shown a reciprocating piston swash plate type refrigerant compressor intended for vehicle use and having incorporated therein the preferred embodiment of the present invention. More specifically, the compressor apart from the present invention is of the type disclosed in detail in co-pending U.S. patent applications Ser. No. 151,710; Ser. No. 151,711; Ser. No. 151,682; and Ser. No. 151,707, all filed May 20, 1980 and assigned to the assignee of this invention and which are all hereby incorporated by reference.

The compressor assembly includes a front head 10, a front cylinder block 12 with an integral cylindrical case, a rear cylinder block 14 also with integral cylindrical case, and a rear head 20. A rear valve plate 26 having discharge valve assemblies 117(R), 118(R) secured to the outboard side thereof is sandwiched together with a suction valve disk 27 on the inboard inside thereof between the rear or working end of the rear cylinder block 14 and the inboard side of the rear head 20 (the suffixes F and R used herein to denote front and rear counterparts in the compressor). A similar valve plate and valve arrangement (not exposed in the drawing) is disposed in similar manner between the front or working end of the front cylinder block 12 and the inboard side of the front head 10.

A swash plate 41 is driven by a shaft 49 that is rotatably supported and axially contained in the cylinder blocks by a journal bearing 50 and a thrust bearing 52 on each side of the swash plate (only the rear bearing arrangement 50(R) and 52(R) being exposed in the drawing.

The cylinder blocks 12 and 14 each have a cluster of three equally, angularly and radially spaced and parallel cylinders 32(F) and 32(R) whose inboard ends are axially spaced from each other and together with the interior of their shells form a central cavity 35 accommodating the swash plate 41. The respective front and rear cylinders each have a cylindrical bore 34(F) and 34(R) all of equal diameter and the bores in the two cylinder blocks are axially aligned with each other and closed at their outboard or working end by their respective valve plate. A double-ended piston 36 is reciprocally mounted in each pair of axially aligned cylinder bores and the pistons are all driven in conventional manner through balls 42 and slippers 48 by the swash plate 41 on rotation thereof.

Fluid supplied to the compressor, in this case gaseous refrigerant, enters through inlet 80 in the rear head (see FIG. 2) and passes internally thereof into a suction chamber 102 in the rear head 20 and a suction chamber (not exposed in the drawing) in the front head 10. The refrigerant received in the rear suction chamber 102 is admitted to the piston head end or working end of the rear cylinder bores 34(R) through separate suction ports 112(R) in the rear valve plate 26 (only that for the lower rear cylinder being exposed in the drawing in FIG. 2). Opening of the suction ports 112(R) during the respective piston suction stroke and closure thereof during the piston discharge stroke is effected by separate reed-type suction valves 114(R) on the piston side of the valve plates which are formed in the rear valve disk 27. Similar suction porting and valving, not exposed in the drawing is provided at the front end of the compressor between the front cylinder bores 34(F) and the suction chamber in the front head 10.

Figure 3:
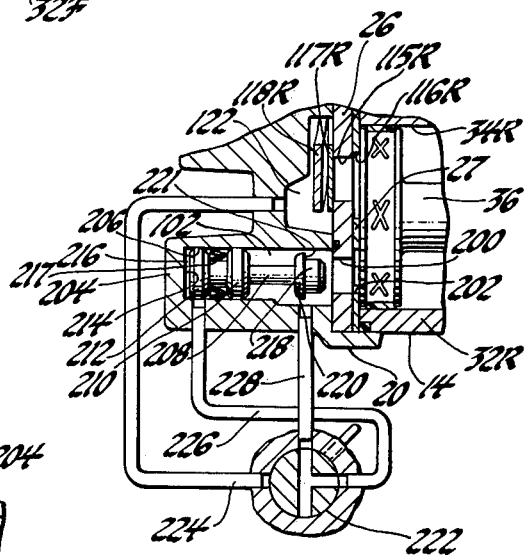
FIG. 3 is a partial view from FIG. 1 showing the valve arrangement in its unload or partial pumping capacity condition.
Figure 2:
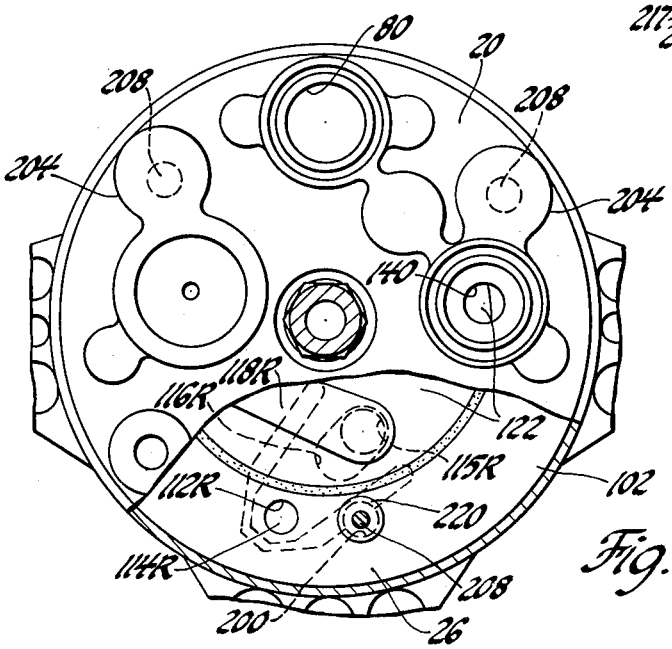
FIG. 2 is a rear end view with parts broken away taken generally along the line 2—2 in FIG. 1.

Discharge of the refrigerant upon compression thereof in the cylinders or compression chambers is to a discharge chamber in the front and rear heads 10 and 20 through separate discharge ports 115 in the valve plates (only that for the lower rear cylinder being exposed in the drawing in FIGS. 2 and 3). As shown for the lower rear cylinder 34(R), its discharge port 115(R) is located in the rear valve plate 26 at the piston or working end thereof and is open thereto through an aperture 116(R) in the valve disk 27. Opening and closing of the discharge ports as shown for the lower rear one 115(R) is to the rear discharge chamber 122 and effected by a separate reed-type discharge valve 117(R) which is backed by a rigid retainer 118(R), both these valve parts being fixed to the outboard side of the rear valve plate. Similar discharge valving (not exposed in the drawing) is provided for the other rear cylinders and also the front cylinders. The discharge chambers in the opposite ends of the compressor are connected to deliver the compressed refrigerant to an outlet 140 in the rear head 20 which opens directly to the rear discharge chamber 122 (See FIG. 2).

The compressor structure thus far described is like that disclosed in detail in the aforementioned U.S. patent applications and for a more detailed description and understanding thereof apart from the preferred embodiment of the present invention now to be described, reference should be made thereto.

According to the present invention, the effective displacement or pumping capacity of the above compressor is simply and efficiently reduced, not by inactivating one or more of the suction valves in its open position, but by obtaining equivalent results by opening a parallel suction port of sufficient area to allow free passage of the refrigerant vapor into and out of the cylinder. According to the present invention, the minimum compressor capacity desired determines the number of cylinders which will thus be unloaded. For the refrigerant compressor shown, the minimum capacity must provide sufficient passenger air cooling capacity under low load conditions and produce enough flow to maintain adequate compressor lubrication. Based on such considerations, it was determined that with the compressor disclosed, it was sufficient to deactivate or unload three of the six cylinders, i.e. 50 percent. This is accomplished at each of the three rear cylinders as shown in detail with respect to the lower one only by a separate additional circular suction port 200 through the rear valve plate 26 which is open through an aperture 202 in the rear valve disk 27 to the working or head end of the respective cylinder 34(R) adjacent the valved suction port 112(R) therefor. Thus, the additional port 200 is connected in parallel with the associated normal suction port 112(R) to provide a bypass passage therepast to the rear suction chamber 102. An outwardly extending boss 204 is formed integral with the rear head 20 opposite the bypass port 200 for each rear cylinder and a blind cylindrical bore 206 is formed therein which intersects or opens to the rear suction chamber 102 and is axially aligned with the respective circular bypass port.

A reciprocable bypass valve 208 of spool type construction is mounted with spaced lands 210 and 212 of equal diameter in the valve bore 206 and cooperates at its end land 212 with the closed end 214 of the valve bore to form a valve actuating chamber 216. An elastomeric ring seal 217 is mounted on the valve between the lands 210, 212 to prevent leakage therepast. The bypass valve 208 is provided at its other end with a land 218 of reduced diameter which is closely receivable by the bypass port 200 as shown in FIG. 1 while a radially outwardly projecting annulus 220 also formed integral with the bypass valve and adjoining the small diameter land 218 inboard thereof is provided with a radial valve face 221 of larger diameter to seat on the outboard side of the valve plate 26 about the bypass port 200 to thereby close same. Alternatively, the bypass valve 208 is movable in the valve bore 206 to the position shown in FIG. 3 where the valve land 218 is completely removed from the bypass port 200 and the valve face 221 is removed from its seat on the valve plate 26 to fully open the bypass port 200 and thus open the head end of compression chamber of the respective cylinder to the suction chamber 102 (the suction side of the compressor). To provide for most efficient bypass flow, the bypass port 200 is provided with a flow area (size) equal to or greater than that of the suction port 112(R).

Operation of the bypass valves 208 is under the control of a rotary three-way control valve 222 which may be operated either manually or automatically and in a normal load or full pumping capacity condition as shown in FIG. 1 connects the rear discharge chamber 122 (the discharge side) via a discharge line 224 and thence an operating line 226 to the actuating chamber 216 of each bypass valve 208 while blocking a suction line 228 connected to the rear suction chamber 102. The end area of the bypass valve 208 at its end land 212 is made substantially greater than the end area of the other end land 218 at the bypass port 200 and with the compressor in operation and the control valve 222 in its normal load or full pumping capacity condition as shown in FIG. 1, the closing force (rightwardly acting) exerted on the bypass valve 208 by the cylinder discharge pressure acting in the valve activating chamber 216 on the large pressure responsive area at large land 212 substantially exceeds the opening force (leftwardly acting) exerted by this same pressure direct from the compressor cylinder acting on the small pressure responsive area at small land 218 through bypass port 200 so that the valve face 221 of the bypass valve is forced firmly against the valve plate 26 and seals the bypass port 200. However, on initial compressor start-up, there will be some delay in buildup of discharge pressure in the bypass valve activating chamber 216 because of the intervening discharge chamber 122 and also because of the remoteness of the activating chamber from the cylinder as compared to the other end of the bypass valve which directly faces the cylinder through the bypass port 200 and as a result, the bypass valve will momentarily open, i.e. a transient fluid pressure force imbalance on the bypass valve in the opening direction (leftward). With such transient bypass valve opening, excessive cylinder pressure during the start-up is then allowed to escape back to the suction chamber 102 via the bypass port 200 to thus reduce the start-up torque. After such transient start-up bypass valve condition, the closing force imbalance on the bypass valve will establish and thereafter remain during continuing (non-intermittent) compressor operation so that the bypass port 200 remains closed and the associated cylinder thus provides pumping operation in the normal manner.

Alternatively, when reduced pumping capacity is desired, the rear cylinders are unloaded by rotation of the control valve 222 to an unloading or reduced pumping capacity condition shown in FIG. 3 wherein the control valve then disconnects the discharge line 224 from the activating chamber 216 of each bypass valve 208 and instead connects these chambers to the suction chamber 102 via the suction line 228 and thence the operating line 226. As a result, the bypass valve actuating chamber pressure is equalized with suction pressure and the opening force thus exerted on the bypass valve at the end of small land 218 by the discharge pressure developed during the compressor stroke then exceeds the product of the suction pressure times the large pressure responsive area at the other end of the valve at large land 212 causing the valve to retract leftwardly into the rear head 20 as shown. With the bypass port 200 then fully open, the vapor displaced by the piston on subsequent strokes is simply displaced through the open bypass port 200 back to the suction chamber 102 (suction side) thereby effectively eliminating any pumping effect by this cylinder.

Having described the lower bypass valve 208 in detail, it will be understood that the bypass valves provided for the other two rear cylinders (the two upper ones) are identical thereto and are similarly and simultaneously operated by the control valve 222 under manual or automatic control. It will be understood that the three bypass valves 208 could also be operated separately and in a certain sequence depending upon the degree of pumping capacity desired.

Where all three rear cylinders are controlled simultaneously, it was found that the results could be generalized and classified under four different load conditions; namely low, medium, high and very high, (such conditions occurring as functions of ambient temperature, humidity, blower speeds, compressor speed and car body). At low loads, it was found that the compressor torque was reduced by about 30%, the cycling rates were reduced by about 33%, the average horsepower was slightly greater and the performance slightly better. At medium loads, the torque was reduced by about 30%, cycling was eliminated, the average horsepower was slightly reduced and the performance was acceptable. At high loads, the torque was reduced about 30%, the average horsepower was significantly reduced and the performance remained acceptable. At very high loads, it was found that three cylinder operation (three unloaded) was not feasible. Thus with the present invention it can be seen that torque variations have been substantially reduced in both magnitude and frequency and that such control can be achieved relative easy and with a very small weight addition which in an actual construction was made at less than one pound. Furthermore, acceptable system performance is maintained making an overall net gain in fuel economy possible.

The above described preferred embodiment is illustrative of the invention which may be modified within the scope of the appended claims.

The embodiments of the invention in which an exclusive property or privilege is claimed are defined as follows:

1. In a variable capacity compressor of the positive displacement type having one or more compression chambers each with a suction valve and further having a variable pumping capacity control arrangement wherein the pumping capacity is varied by effecting communication between the compressor's suction side and one or more of the compression chambers during compression: an improved variable capacity control arrangement comprising in combination, a bypass passage connected in parallel with at least one of the suction valves between the fluid supply and the respective compression chamber, bypass valve means operable to open and close said bypass passage, said bypass valve means having a first pressure responsive area acted on by fluid pressure direct from the associated compression chamber through said bypass passage whereby said bypass valve means is urged thereby to open said bypass passage, said bypass valve means further having a second pressure responsive area substantially larger than and facing in a direction opposed to said first pressure responsive area, and control means for alternately communicating said second pressure responsive area with either the suction side in a reduced capacity demand condition or the discharge pressure from the compression chamber to which said bypass passage is connected in a normal capacity demand condition whereby in said reduced capacity demand condition the force exerted on said bypass valve means during compression by the compression chamber pressure acting on said first pressure responsive area substantially exceeds the force exerted by the suction pressure acting on said second pressure responsive area so that said bypass valve means is moved by such force imbalance and thereafter maintained to open said bypass passage and unload the compression chamber to which the bypass passage is connected and, alternatively, in said normal capacity demand condition the force exerted on said bypass valve means by the discharge pressure acting on said second pressure responsive area remains greater than the force exerted by the pressure in the compression chamber acting on said first pressure responsive area so that said bypass valve means is moved by such force imbalance and thereafter maintained to close said bypass passage to establish and maintain the normal pumping capacity of the compression chamber to which the bypass passage is connected except upon compressor start-up whereupon said bypass valve means is moved by a transient force imbalance thereon to momentarily open said bypass passage and unload the connected compression chamber and thereby reduce start-up torque.

2. In a variable capacity compressor of the positive displacement type having one or more cylinders each with a reciprocating piston and suction and discharge valves and further having a variable pumping capacity control arrangement wherein the pumping capacity is varied by effecting communication between the compressor's suction side and one or more of the cylinders during compression: an improved variable capacity control arrangement comprising in combination, a bypass passage connected in parallel with at least one of the suction valves between the suction side and the respective cylinder, bypass valve means operable to open and close said bypass passage, said bypass valve means having a first pressure responsive area acted on by fluid pressure direct from the associated cylinder through said bypass passage whereby said bypass valve means is urged thereby to open said bypass passage, said bypass valve means further having a second pressure responsive area substantially larger than and facing in a direction opposed to said first pressure responsive area, and control means for alternately communicating said second pressure responsive area with either the suction side in a reduced capacity demand condition or the discharge pressure through the discharge valve from the cylinder to which said bypass passage is connected in a normal capacity demand condition whereby in said reduced capacity demand condition the force exerted on said bypass valve means during the compression stroke by the cylinder pressure acting on said first pressure responsive area substantially exceeds the force exerted by the suction pressure acting on said second pressure responsive area so that said bypass valve means is moved by such force imbalance and thereafter maintained to open said bypass passage and unload the cylinder to which the bypass passage is connected and, alternatively, in said normal capacity demand condition the force exerted on said bypass valve means by the discharge pressure acting on said second pressure responsive area remains greater than the force exerted by the pressure in the cylinder acting on said first pressure responsive area so that said bypass valve means is moved by such force imbalance and thereafter maintained to close said bypass passage to establish and maintain the normal pumping capacity of the cylinder to which the bypass passage is connected except upon compressor start-up whereupon said bypass valve means is moved by a transient force imbalance thereon to momentarily open said bypass passage and unload the connected cylinder and thereby reduce start-up torque.

3. In a variable capacity compressor of the positive displacement type having one or more cylinders each with a reciprocating piston and suction and discharge valves and further having a variable pumping capacity control arrangement wherein the pumping capacity is varied by effecting communication between the compressor's suction side and one or more of the cylinders during compression: an improved variable capacity control arrangement comprising in combination, a bypass passage connected in parallel with at least one of the suction valves between the suction side and the respective cylinder, said bypass passage comprising a port formed in a wall separating the working end of the associated cylinder and the suction side, bypass valve means operable to open and close said bypass passage, said bypass valve means having a small pressure responsive area acted on in said port by fluid pressure direct from the associated cylinder through said port whereby said bypass valve means is urged thereby to open said bypass passage, said bypass valve means further having a large pressure responsive area larger than and facing in a direction opposed to said small pressure responsive area, and control means for alternately communicating said second pressure responsive area with either the suction side in a reduced capacity demand condition or the discharge pressure through the discharge valve from the cylinder to which said bypass passage is connected in a normal capacity demand condition whereby in said reduced capacity demand condition the force exerted on said bypass valve means during the compression stroke by the cylinder pressure acting on said small pressure responsive area substantially exceeds the force exerted by the suction pressure acting on said large pressure responsive area so that said bypass valve means is moved by such force imbalance and thereafter maintained to open said bypass passage and unload the cylinder to which the bypass passage is connected and, alternatively, in said normal capacity demand condition the force exerted on said bypass valve means by the discharge pressure acting on said large pressure responsive area remains greater than the force exerted by the pressure in the cylinder acting on said small pressure responsive area so that said bypass valve means is moved by such force imbalance and thereafter maintained to close said bypass passage to establish and maintain the normal pumping capacity of the cylinder to which the bypass passage is connected except upon compressor start-up whereupon said bypass valve means is moved by a transient force imbalance thereon to momentarily open said bypass passage and unload the connected cylinder and thereby reduce start-up torque.

* * * * *